US007650651B2

(12) United States Patent
Lohnert

(10) Patent No.: US 7,650,651 B2
(45) Date of Patent: Jan. 26, 2010

(54) DRAIN CLOSURE WITH CLEARING TOOL

(76) Inventor: Michael C. Lohnert, E3015 Marina Landing, 1300 N. 20th St., Renton, WA (US) 98056

( * ) Notice: Subject to any disclaimer, the term of this patent is extended or adjusted under 35 U.S.C. 154(b) by 512 days.

(21) Appl. No.: 11/377,525

(22) Filed: Mar. 16, 2006

(65) Prior Publication Data

US 2006/0207004 A1 Sep. 21, 2006

Related U.S. Application Data

(60) Provisional application No. 60/662,775, filed on Mar. 17, 2005.

(51) Int. Cl.
*A47K 1/14* (2006.01)

(52) U.S. Cl. ..... 4/295

(58) Field of Classification Search ..... 241/272; 4/295

See application file for complete search history.

(56) References Cited

U.S. PATENT DOCUMENTS 5,404,596 A 4/1995 Corry
6,067,669 A * 5/2000 Peterson et al. ..... 4/287
6,138,290 A 10/2000 Lin
6,418,570 B1 7/2002 Ball
6,775,873 B2 * 8/2004 Luoma ..... 15/104.33

FOREIGN PATENT DOCUMENTS

JP 10121538 A * 5/1998

* cited by examiner

*Primary Examiner*—Gregory L Huson
*Assistant Examiner*—Karen Younkins
(74) *Attorney, Agent, or Firm*—The Webb Law Firm

(57) ABSTRACT

A drain closure with clearing tool that incorporates a drain basket having internal cross members which intersect to carry a slide shaft movably mounting a closure assembly. The closure assembly includes one or more clearing tools that project into the drain basket. The clearing tool may include optional blades that coact with the internal cross members to shred hair and soap particles captured in the drain basket. The cleaning tool may also include optional grip elements that extend into the drain to capture hair and debris to prevent accumulation in the drain basket and underlying plumbing. In the latter modification, clogs and blockages may be prevented if the drain closure is periodically removed to withdraw such captured debris from the drain basket and the underlying plumbing. After such debris is released from the grip elements, the drain closure and grip elements are reinserted into the drain basket for continued operation.

17 Claims, 7 Drawing Sheets

DRAIN CLOSURE WITH CLEARING TOOL

CROSS REFERENCE TO RELATED APPLICATION

This application claims the benefit of U.S. Provisional Patent Application No. 60/662,775 filed Mar. 17, 2005.

BACKGROUND OF THE INVENTION

1. Field of the Invention

Wash basins, sinks, bath tubs, shower stalls, and similar enclosures incorporate drains for disposal of waste fluids such as water. Such drains incorporate a variety of closure devices and mechanisms that may become fouled and or clogged with debris such as hair and soap particles and residue. The present invention incorporates novel components and tools into such closure devices and mechanisms that enable an integrated cleaning and clearing capability.

2. Description of Prior Art

Many types of industrial, commercial, and residential enclosures have been made to contain fluids needed for a variety of applications that can include spraying, coating, washing, showering, mixing, cleaning, and other uses of fluids. In residential and similar industrial applications showers, tubs, sinks, wash basins, and the like have incorporated sumps and drains that are used to continuously or periodically evacuate the fluid contained therein.

Such sumps and drains have included valves and closure devices and related components that enable the drain and sump to be opened and closed. During use, sumps, drains, and the integrated valves and closure components can become fouled and clogged with residue, debris, and particles as the contained fluid flows down the drain and is evacuated.

In residential applications, such drains and closure devices can become clogged with hair and soap particles and residue as water flows out of the sink, bath, shower, tub, or similar enclosure. For as long as such enclosures have existed, the problem of clearing clogs of hair and soap debris from the drains and sumps has persisted. In the present, many drains incorporate a drain apparatus that includes a drain basket and a closure device that seals the drain basket to temporarily retain water in the enclosure. Drain closure devices can be made from a simple polymeric type stopper or plug construction, or may be arranged to mechanically cooperate with the drain basket to seal and open the drain.

Such drain baskets are typically fastened to the sump or lowest point in the tub, sink, shower stall, or other enclosure and to an underlying drain pipe so that unwanted fluid or drainage, such as water, flows under the force of gravity into the drain basket for evacuation from the enclosure.

There have been a number of prior attempts to improve the state of the art of such drains and closure devices. One attempt has sought to improve the related art of clearing waste substances such as food from drains and is described in U.S. Pat. No. 5,404,596 to Coory. This device is limited to an integrally formed plunger or scraper including two or more scraper blades that project from a handle having water passage slots that is used to move waste substances into and down a disposal unit. U.S. Pat. No. 6,138,290 to Lin describes an improved drain closure that includes a movable drain closure fitting that slides on a guide post shaft connected to a drain fitting or basket. The Lin drain basket also includes arms that extend inwardly to form a threaded guide post holder that receives the shaft.

U.S. Pat. No. 6,418,570 to Ball discloses a similar type of drain and closure device, which further includes a resilient material that cooperates with the guide post to frictionally hold the position of the closure at any point between fully open and fully closed positions. These prior attempts also inherently enable the capture of hair and soap particles about the inwardly extending arms of the drain. However, those knowledgeable in the arts have found that such capturing can foul the drain basket and form a clog therein. In other circumstances, such capture of hair and debris by the arms is limited and does not prevent the accumulation of hair and debris in downstream sections of the drain and drain pipe, which also results in clogs.

In some applications, the inwardly expanding arms or cross members are also commonly adapted with multiple such arms or cross members to better capture foreign material to prevent downstream clogs.

Another previous effort to avoid such downstream clogs is described in U.S. Pat. No. 6,775,873 to Luoma. This apparatus includes an elongate, flexible strip with an attached handle. The flexible strip is inserted into a drain basket and extends into the underlying drain pipe. The strip further includes barbed portions that extend outwardly from the strip to grip hair moving along the strip in the drain pipe during use of the drain. This arrangement seeks to capture hair during continuous evacuation of fluid through a drain. When the strip is removed, the captured hair is thereby removed from the drain pipe and drain basket in an attempt to prevent clogs. However, the barbed portions may not grip and capture all such hair moving past the strip, which may still lead to clogging. Additionally, the flexible strip may break and form a clog itself. Each of the noted patents is incorporated by reference in their entirety.

Those having skill in the relevant arts will appreciate that such prior attempts fall short of solving the myriad problems associated with drain clogs that result from the buildup of hair and soap particles and residue. Some of the noted attempts describe drain closures that enable the removal of drain clogging hair and debris before evacuation of the fluid or water in the enclosure. However, these devices do not enable the continuous evacuation of fluid or water during use of the enclosure, and it may be undesirable to have fluid and water accumulate in the enclosure. Other attempts that seek to grip or capture hair during continuous evacuation can introduce new sources of drain fouling and clogs.

Despite these prior attempts, the problems of drain fouling and clogging persist. What continues to be needed are improvements that enable an improved capability to clear and clean clogs. It is also desirable to enable the capability to periodically service drains to clean and clear pre-clog accumulation of hair and soap debris. Even the noted prior devices continue to become fouled and clogged, which necessitates more extensive use of other drain cleaning and clearing tools such as drain snakes, plungers, and even pipe wrenches, screwdrivers, and pliers.

While in some situations, such as those disclosed in the Coory patent, undersink, electric waste disposals can be incorporated that collect and shred foreign matter to enable the resulting particles to be evacuated with the waste fluid and into the drain and wastewater system. However, such electric waste disposal devices create considerable noise and therefore have limited utility and are undesirable for use in residential bathroom fixtures and the like, among other unsuitable locations.

Without such electric waste disposal devices, clogs and blockages from hair, soap particles, and other residue and debris persist. Methods to clean and clear such clogs and blockages usually require a substantial investment of time, and include the aforementioned tools as well as the use of chemicals, disassembly of the drain and downstream plumping and pipes, and the intervention of plumbers and other similarly skilled and equipped experts. Each of these possible solutions introduces additional issues.

For example, chemical clog removal techniques can produce noxious gas, and can result in exposure of skin and equipment to the possibly damaging chemicals. Further, chemicals rely on the capability to dissolve and cause the disintegration of the material causing the clog. Many chemical solutions may flow past a partial clog or blockage and will not remain in contact for a long enough time to have the desired cleaning and clearing effect.

Additionally, chemical cleaning and clearing methods can have no effect on mechanical clogs and blockages. Manually cleaning and clearing solutions using the noted tools and equipment can introduce further damage when aged, rusted plumbing and piping must be disassembled to clear and clean clogged plumbing. Finding a reputable professional is difficult and can be costly and time consuming.

The present invention addresses many of these and other issues with new and as yet unavailable drain closures and drain clearing tools and devices that enable periodic, low cost, and minimally time consuming preventative maintenance capabilities as well as integrated clearing and cleaning options that reduce the need for chemicals, professional intervention, and other tools and drain clearing and cleaning equipment.

SUMMARY OF INVENTION

The present invention addresses many problems that exist in the prior art in new ways that enable more convenient periodic maintenance of drain closures and drain plumbing that may reduce the likelihood of clogs and blockages. The many possibly preferred variations of the proposed drain closures preferably include integrated drain clearing tools that can minimize the need for complicated extra equipment or professional assistance.

In one preferred embodiment according to the principles of the invention, a drain closure incorporates a drain basket with an inlet defined by a flange that is connected by a conduit or tube to an opposite outlet. One or more cross members are carried inside the tube, which extend radially inward to intersect centrally within the tube and to define a threaded guide aperture in the intersection.

A slide shaft is also included in the drain closure and is formed with a coupler end that is preferably threadably received in the guide aperture and which extends to an integrally formed slide stop proximate to an intermediate slide contour. The slide contour is preferably separated from the slide stop by a seat groove, which is received with a movement resisting element such as an O-ring, garter spring, C-ring, or other similar device.

The drain closure also incorporates a closure assembly which is defined with an exterior seat groove received with a seal that sealingly coacts with the flange to obstruct fluid flow when urged against the flange of the drain basket. The drain closure is preferably movably received on the slide shaft about a slide bore that may be centrally defined in the closure assembly, and which extends between an upper or superiorly positioned handle portion or cap seat and an opposite second end. More preferably, the closure assembly further carries and or includes an integral and or attached at least one clearing tool, which projects inferiorly from the second end. The handle portion may extend outwardly to define a handle or knob element.

The drain closure also further includes in one variation one or more blades that form a part of the clearing tool. Typically, the blades depend from an underside of the closure assembly and project downwardly into the drain and or inferiorly from the second end of the underside of the closure assembly. The blades are respectively formed about a furthest extent with a cutting edge. Preferably, each blade is positionally keyed and or arranged or registered about the clearing tool to cooperate and coact with a respective one or more cross members. The slide shaft may be keyed to the drain closure for this purpose.

Depending upon the desired mode of operation of the optionally preferred cross members, the respective one or more or at least one cross member has at least one respective shear edge. More preferably, the shear edge is also positioned about the drain basket to cooperate with the cutting edge as the closure assembly is moved about the slide shaft. In variations of the optionally preferred modifications on the invention, the cutting and shear edges may cooperatively coact in shearing, cutting, and similarly coactive ways to rend, grind, and otherwise disintegrate debris captured and retained about the drain basket.

One possibly preferred variation of the invention contemplates a plurality of such blades to be included in the clearing tool, all projecting inferiorly from the second end and having respective cutting edges. Such a plurality of blades are positioned about the closure assembly and clearing tool to be cooperatively registered with and or positionally keyed to coact with respective and corresponding one or more cross members to accomplish the desired disintegration of the debris.

In further optionally desirable modifications, the one or more cross members may include oppositely facing and parallel radial sides that are joined by a superior shear wall defining shear edges at the intersections with the sides. The shear edges are preferably positioned to cooperate in a rending, disintegrating, and or shearing action with the cutting edges that slide respectively about the opposite radial sides of the shear edges as the closure assembly is moved about the slide shaft.

Additionally preferred optional modifications may include the one or more or at least one cross member to include pairs of and or opposite radial sides joined by a superior shear edge that may be a knife type edge. Alternatively or cooperatively, the superior shear edge may also include and or define a collector notch that inclines or extends in a downstream, fluid flow direction to better capture hair and other debris that might otherwise find its way into and accumulate within a drain pipe and in plumbing beneath the drain basket of the present invention.

As with other optionally preferred configurations of the inventive drain closure, the shear edge is more preferably positioned about the closure assembly and the clearing tool to cooperate and coact in a rending, disintegrating, and or in a shearing action with the cutting edges of the drain basket cross members. This is effected, as the blades slide about and over each of the respective, opposite radial sides of the shear edge or wall, as the closure assembly and clearing tool are moved about the slide shaft.

Any of the preferred embodiments of the invention may also further include one or more resistance elements, which may be received about the seat groove of the slide shaft and elsewhere about other grooves or interstices. More preferably, the resistance element or movement resisting element such as an O-ring, garter spring, C-ring, or other similar device, is selected to have a size that will induce friction against the inside of the slide bore. Even more preferably, the resistance element is selected to have a shape and size whereby the resistance element is sized for receipt in the central slide bore in a friction-fit or compressed state to enable frictional interaction between the slide shaft, resistance element, and the closure assembly. More than one such resistance element is contemplated. In operation, the resistance element enables the closure assembly to be positioned at any preferred position between and including fully opened and fully closed.

The present invention also further contemplates further modifications wherein two or more pairs of blades may be included in the clearing tool in a configuration similar to any of the preceding exemplary embodiments. In these optionally preferred arrangements, the pairs of blades are positioned to coact with respective ones of the cross members in ways similar to those already described. The proposed drain closure variations may also be adapted with a cap that may preferably be threadably received about a cap seat or handle portion of the closure assembly, and which may also include and a superiorly projecting handle that may be preferred for grasping and actuating the closure assembly.

Yet more alternative modifications of the embodiments of the invention are contemplated and include, for further example but not for purposes of limitation, the drain closure further preferably including at least one optional capture element. One possible capture element contemplates hook members incorporated about or in place of the blades and to form a part of or the entire clearing tool. Also, a flexible capture strip may be included and may have a distal grip element, which are together incorporated in the clearing tool, and which project inferiorly from the second end of the closure assembly or from the clearing tool. The optionally preferred flexible capture strip may further extend down into the drain basket and into the underlying plumbing. More preferably, the distal grip element may be formed from a water proof adhesive selected to have a releasable or permanent capture affinity for debris such as hair, soap particles, or any other debris that may clog or block a drain. The capture strip may be replaceable and substantially planar and the distal grip element may include one or more barbs protruding out of the plane of the at least one capture strip.

In operation, using any of the preceding embodiments, and in any of the variations thereof, those skilled in the relevant arts will also appreciate one or more methods of using and applying the inventive drain closure and clearing tool. One possible method for clearing a drain of a water enclosure, which is at least partially occluded with debris while using the drain closure with clearing tool according to the invention is described. In a first step, the drain closure assembly is actuated or depressed from a superior or open position to an inferior or fully or nearly closed position so that the blades of the clearing tool coact with the at least one cross member to rend captured and retained debris into smaller particles for passage into the drain pipe below the drain basket.

In a next step, the drain closure assembly is lifted up again to the superior position, and fresh fluid such as water is supplied and evacuated and or allowed to flow down the drain to wash away the rending debris. After observing whether any debris remains, the steps may be repeated so that the drain basket is cleared of debris, which enables free flow of fluid from the water enclosure. In alternative methods of operation, the clearing tool further carries the at least one capture strip which includes the distal grip element. In these methods, the capture strip and grip element are periodically removed from the drain basket so that captured hair and other debris may be removed from the drain.

These variations, modifications, and alterations of the various preferred and optional embodiments may be used either alone or in combination with one another and with the features and elements already known in the prior art herein described, which can be better understood by those with relevant skills in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures, wherein like reference numerals across the several drawings, figures, and views refer to identical, corresponding, or equivalent elements, components, features, and parts:

DESCRIPTION OF THE PREFERRED EMBODIMENTS

Figure 1:
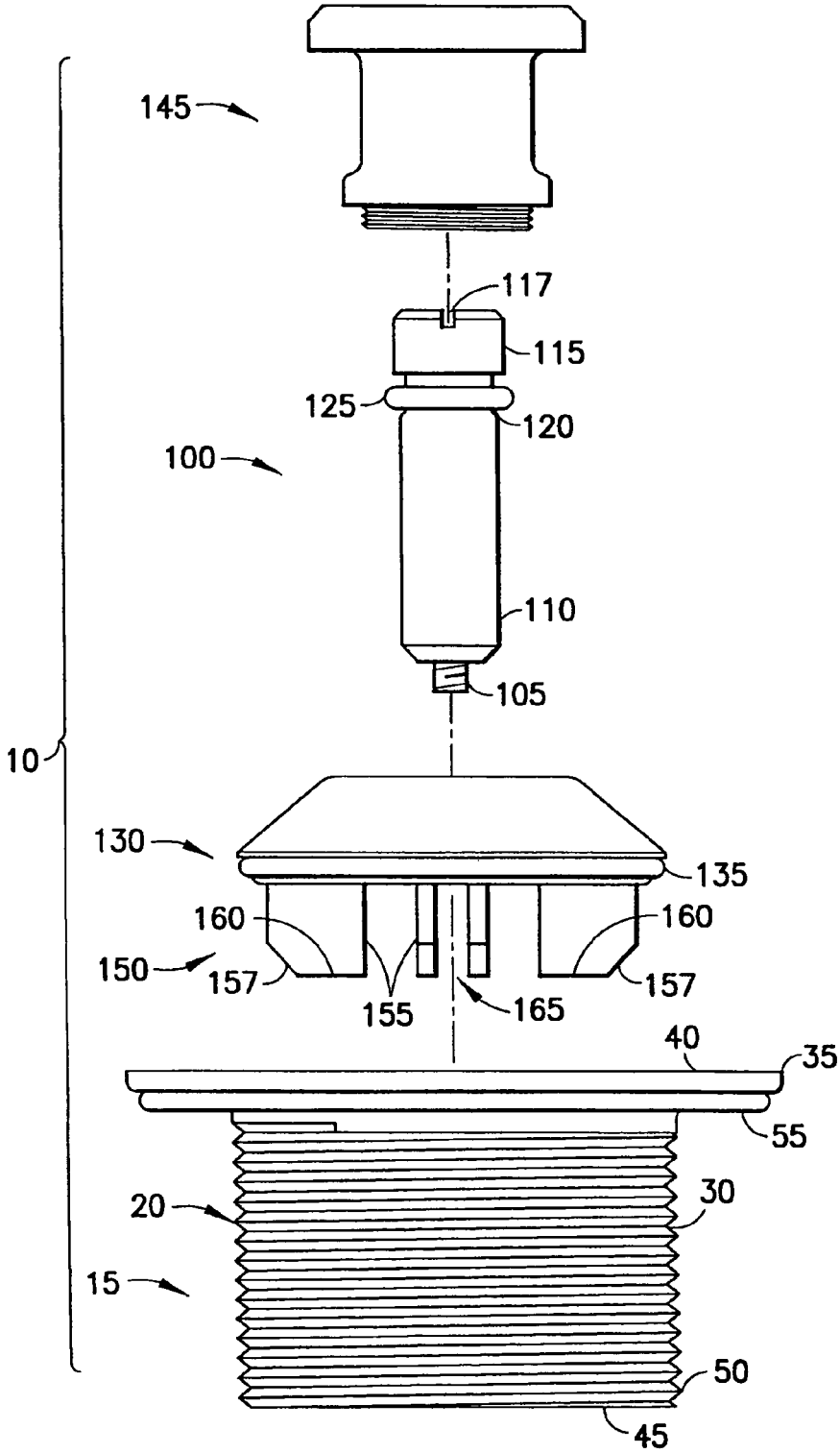
FIG. 1 is a partially exploded elevational view of the drain closure with clearing tool according to the present invention.

The new drain closures of the present invention introduce improved devices that include integrated clearing and cleaning capabilities as cost-effective alternatives to conventional drain closures. Further, the innovative devices of the invention can reduce previous reliance on less desirable and more costly drain clearing techniques that included chemical treatments, plunger, snake, and other professional drain and pipe clearing implements. With reference now to the various figures and illustrations of the invention, attention is specifically invited to FIGS. 1 and 2 wherein a first preferred embodiment of the invention depicts a drain closure designated generally by reference numeral 10.

Figure 3:
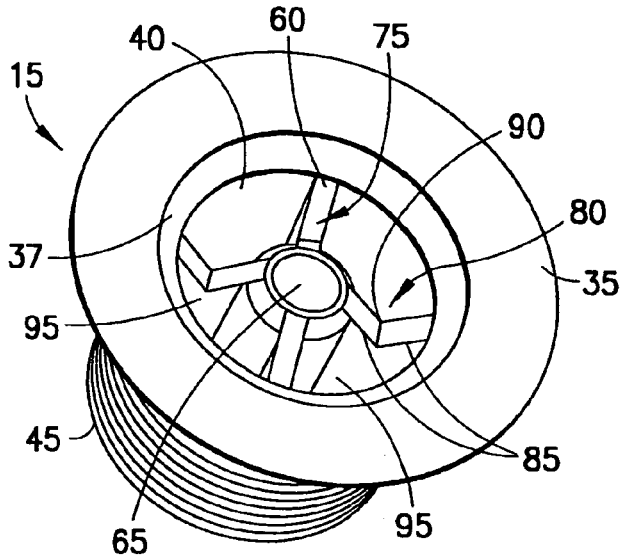
FIG. 3 is an isometric elevational view of a component of the drain closure of the preceding figures.
Figure 4:
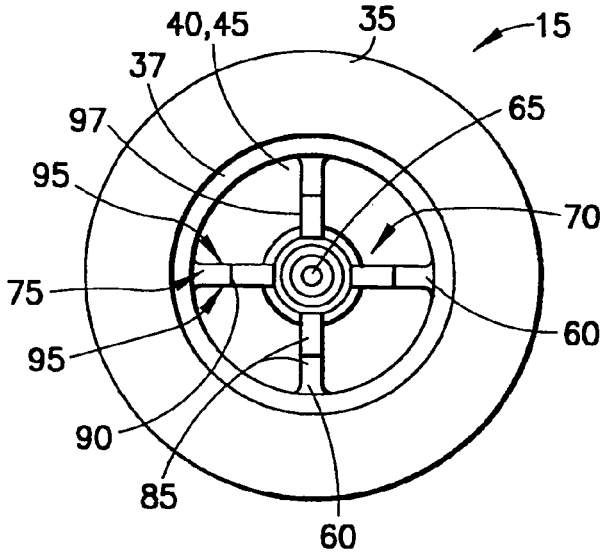
FIG. 4 is a plan view of a superior side of the component of FIG. 4.

The drain closure 10 preferably includes a drain basket 15 that is also illustrated in the enlarged and rotated views of FIGS. 3 and 4. The drain basket 15 is formed from a tubular conduit or tube 20 with inner and outer surfaces 25, 30 and which has at one end a flange 35 that defines an upstream through inlet 40 extending to an opposite downstream outlet 45, which connects to a drain pipe or other plumbing underlying a fluid and or water enclosure (not shown) that incorporates the drain closure 10.

The flange 35 may also include a tapered or chamfered alignment ramp 37 at the transition point to the inner surface 25. The outer surface 30 may preferably include optional threads 50 and a sump seal 55 received beneath the flange 35 to prevent leaks under the flange 35 when the drain basket 15 is installed in a sump area of the water enclosure, which can be a tub, shower, sink, or other water wash basin (not shown).

At least one, and more preferably a plurality of cross members 60 are carried inside the tube 20 about the inner surface 25 in a spaced apart and keyed arrangement for cooperation with other elements of the drain closure 10 described elsewhere herein. The cross members 60 extend inwardly as radial arms and centrally intersect to define and establish a central guide bore or aperture 65 about the intersection 70. Each cross member 60 has at least one respective superiorly extending shear wall 75 that may optionally be formed as a knife edge.

The shear wall 75 may further include and or define an optional collector notch 80 that preferably has inclined ramp portions 85 that extend in a downstream, fluid flow direction D toward the outlet 45 to urge debris such as hair and other particles that are captured and retained by the cross member 60 down the inclined ramp portions 85 toward a nadir point 90 of the notch 80. The upstream or superiorly projecting shear wall 75 of the one or more cross members 60 may also join oppositely facing and parallel radial sides 95 that define shear edges 97 at the intersections with the shear wall 75. Although shown in the various illustrations to have a substantially V-shaped configuration, the notch 80 may be further adapted in curvilinear and other profiles with possibly equally effective results.

Figure 2:
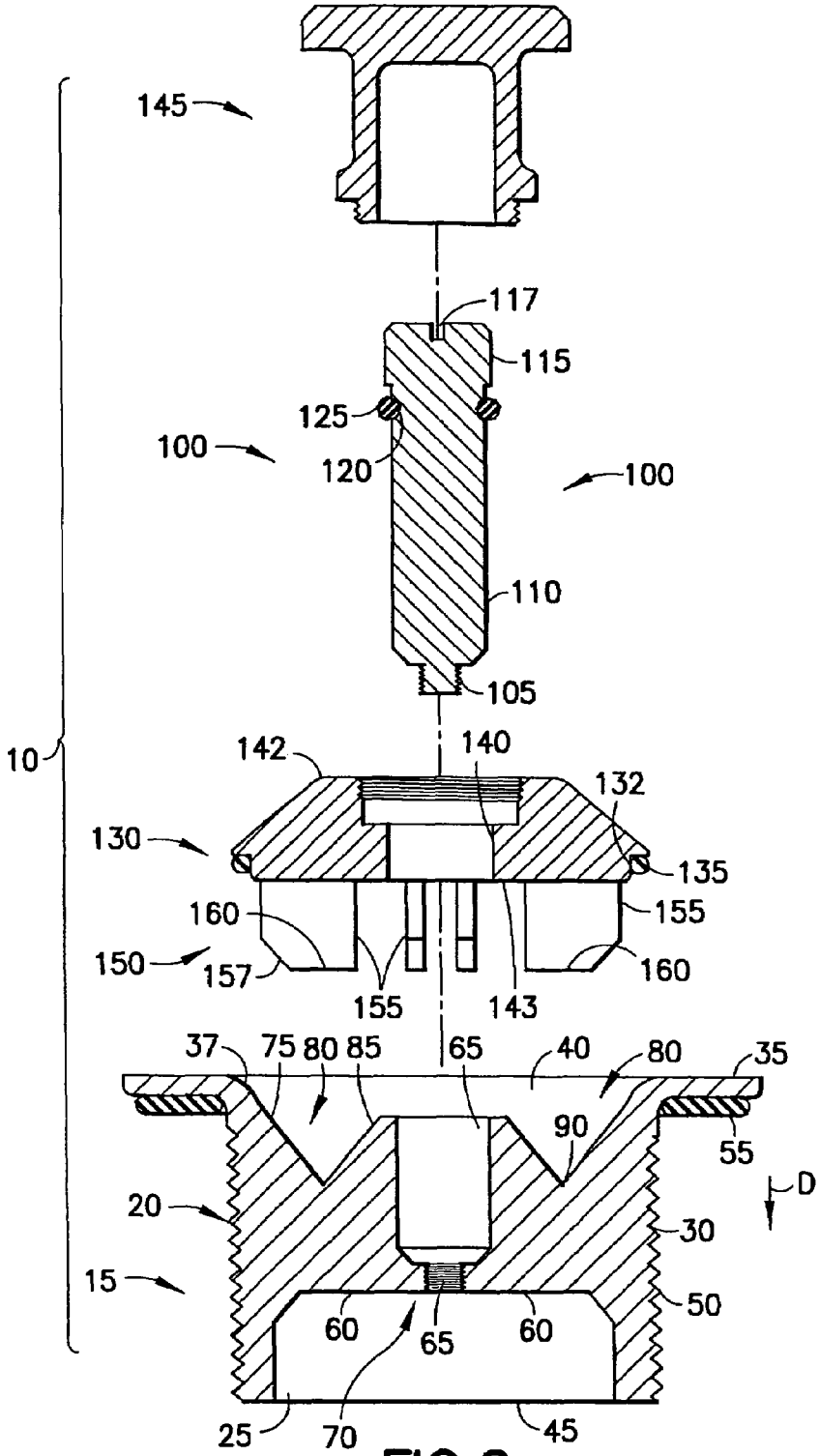
FIG. 2 is a cross section elevation view of the drain closure of the invention with various structure removed for purposes of illustration.

In FIGS. 1 and 2, those skilled in the art will understand that the drain closure 10 also preferably incorporates a slide shaft 100. The slide shaft 100 is preferably formed with a coupler end 105 that is preferably releasably received in a bayonet type fitting and or threadably in the guide aperture 65. The slide shaft 100 may be cylindrical for certain applications and will typically extend through a slide contour 110 to an integrally formed slide stop 115 that may be separated from the slide contour 110 by a seat groove 120. Although not shown in the Figures, a slot may be formed along the length of the shaft to key or register components of the drain closure 10.

The slide stop 115 may include at an outer extent a slot 117, thumb-type knob or other feature (not shown) that facilitates installing the coupler end 105 of the slide shaft 100 into the central guide bore 65. The seat groove 120 may be integrally coated with or may receive a movement resisting or resistance element 125. The resistance element 125 may be formed as an integrated polymeric coating, and may also be an O-ring, garter spring, C-ring, or other similarly configured element.

Figure 5:
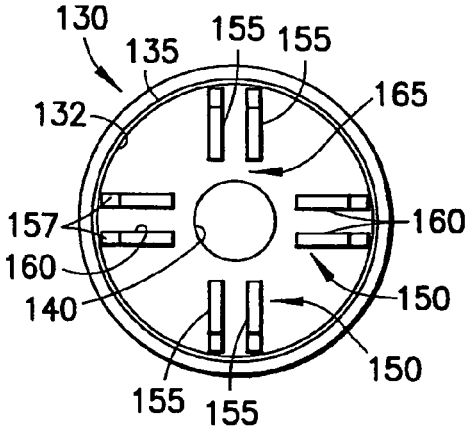
FIG. 5 is a plan view of an inferior side of another component of the drain closure of the preceding figures.

As illustrated in FIGS. 1, 2 and 5, the drain closure 10 also incorporates a closure assembly 130 that may include or be defined with an exterior seat groove 132, which may be received with a drain seal 135. The drain seal 135 coacts with the flange 35 to close the drain 10 and retain fluid in the fluid or water enclosure, when the closure assembly 130 is in a closed position (see, for example, FIG. 8) that urges the seal 135 against the flange 35 of the drain basket 15.

When assembled, the drain closure assembly 130 preferably is slidably or movably received on the slide contour 110 of the slide shaft 100 about a slide bore 140 that may be centrally defined in the closure assembly 130 or with any other equally suitable, non-central manner. The slide bore 140 preferably extends between an upper or superiorly positioned handle portion or cap seat 142 and an opposite second end 143.

More preferably, the slide bore 140 is sized to be received about the slide shaft 100 whereby the resistance element 125 is compressed upon receipt in the slide bore 140. The compression results in an increase coefficient of sliding friction between the resistance element 125 and the slide bore 140 so that the movement of the closure assembly 130 more preferably requires an exterior force to be moved. In this way, the closure assembly 130 preferably is adapted to maintain its position relative to the drain basket 15 until moved.

The handle portion or cap seat 142 may extend outwardly to define an integral handle or knob element (not shown), or may receive a functional and or decoratively adorned cap, handle, or knob 145, which can be formed with any possibly desirable shape and which can also be adorned with promotional or other identification and marking indicia (not shown). The handle 145 may be threadably received in the cap seat 142 to conceal the top of the slide shaft 100, and may also optionally be removable for access to the installation slot or knob or feature 117 of the slide shaft 100.

Although only a single resistance element is shown, multiple such elements 125 may be incorporated in groove seats formed on the shaft 100, the bore 140, or in other components as may be desired. Further, these configurations may be replaced or used in combination with a channel or keyway (not shown) formed longitudinally along the shaft contour 110 that movably receives a pin or key (not shown) projecting therein from the closure assembly 130 to enable the same movement resisting features. Such a keyed arranged may also be preferred in certain applications to more easily obtain the cooperative registration of the components of the drain closure 10 and may be frictionally modified to resist movement.

The closure assembly 130 preferably also includes an integral and or attached at least one clearing tool 150. The clearing tool 150 preferably coacts about and with the drain closure 10, and more preferably coacts with either the drain basket 15, the closure assembly 130, or both. Even more preferably, the clearing tool 150 in various configurations projects inferiorly and in the fluid flow or downstream direction D from the second end 143 of the closure assembly 130, and toward the drain basket 15.

In one optionally preferred variation of the closure assembly 130, at least one or more or a plurality of blades 155 are included to form a part of the clearing tool 150. Preferably, the blades 155 depend from and project inferiorly away from the underside or second end 143 of the closure assembly 130. More preferably, the blades 155 project in the downstream direction D or downwardly into the drain basket 15. Blade guide chamfers 157 may optionally be included about the blades 155 to cooperate with the alignment guide or chamfer 37 of the drain basket 15, to improve the ease with which the closure assembly 130 may be inserted into the drain basket 15 during assembly and in use.

Even more preferably, the blades 155 each respectively include a cutting edge 160 formed about a furthest end or inferior-most extent of the blades 155. Further, each blade 155 is preferably positionally spaced apart about the underside or second end of the drain closure 130 to be in effect, keyed and or arranged or registered about the clearing tool 150 to cooperate and coact with a respective one or more cross members 60, which are similarly spaced apart and keyed in position to correspond with the blades 155.

Although many possibly desirable arrangements of the blades 155 and cross members 60 are contemplated by the principles of the invention, the downwardly projecting length of the blades 155 may be minimized by positioning the cross members 60 to be proximate the flange 35. This possibly preferred configuration can also minimize the stroke distance of the closure assembly 130 that is needed for the clearing tool 150 to rend and clear debris captured about the cross members 60.

As can be understood by those skilled in the art with reference generally to FIG. 5, one possibly preferred modification of the clearing tool 150 contemplates a plurality of such blades 155 to be included in the clearing tool 150. In this variation, the blades 155 are more preferably arranged with two or more pairs 165 of blades 155 incorporated into the clearing tool 150. In this optionally preferred arrangement, the pairs 165 of blades 155 are positioned to cooperate together and coact with a respective one of the cross members 60 whereby each blade 155 of the pair 165 slides along opposite sides 95 of the cross members 60 in a sandwiching or clevis type of arrangement that received the cross member 60, and which is described in further detail elsewhere herein.

The optionally preferred multi-blade arrangements such as the blade pair 165 modification can be particularly well-suited for compatibility with legacy drain basket and strainers such as those described in the above-noted U.S. Pat. Nos. 6,138,290 and 6,418,570. These prior drain baskets or strainers each disclose four cross members and even though they do not contemplate the clearing tools 150 with blades 155, the inventive drain closure assembly 130 can be readily adapted to arrange the pairs 165 of the blades 155 to produce the preferred rending and shearing capabilities of the invention.

Figure 6:
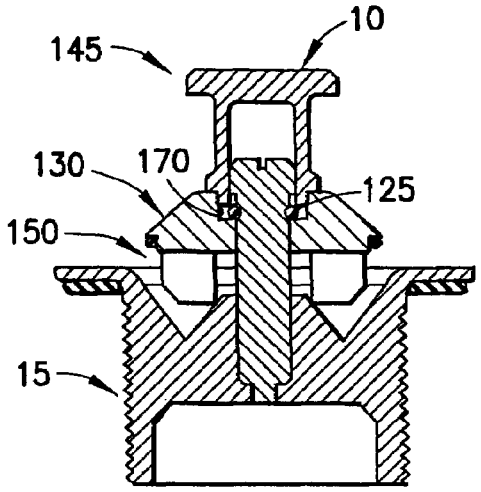
FIG. 6 is a cross section elevational view of the drain closure of the preceding figures assembled and in a partially open position.
Figure 7:
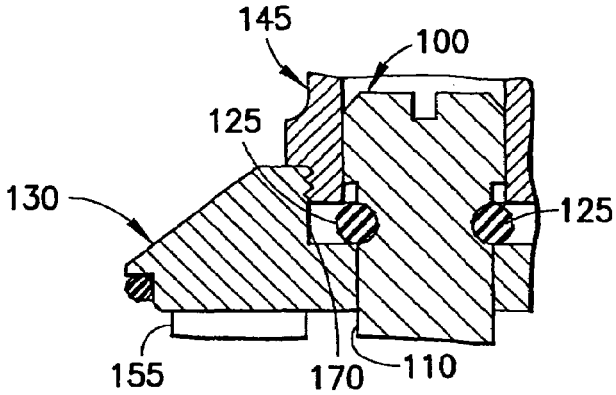
FIG. 7 is a partial detail view, in enlarged scale, of a portion of the drain closure of FIG. 7.
Figure 8:
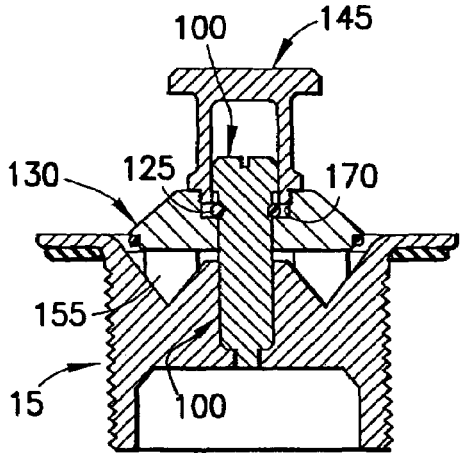
FIG. 8 is a cross section elevational view of the drain closure of the preceding figures in a partially closed position.
Figure 9:
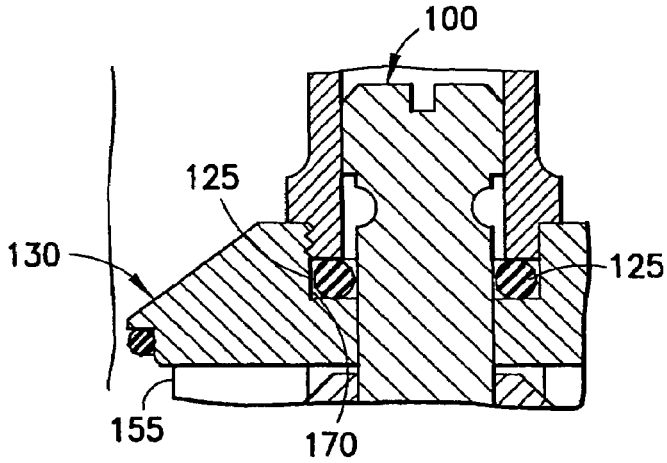
FIG. 9 is a partial detail view, in enlarged scale, of a portion of the drain closure of FIG. 8.

With reference now also to FIGS. 6, 7, 8 and 9, it will be understood that the drain closure 10 operates to have an open position (FIGS. 6, 7) and a closed position (FIGS. 8, 9). In operation, it may be optionally preferred to incorporate one or more tactile feedback elements or detents that also function to enable additional, range of motion stop points, which may set positions of the closure assembly 130 and that may generate tactile feedback to a user. More specifically, the closure assembly 130 may include a groove 170 proximate the handle portion or cap seat 145 that captures and seats the resistance element 125 for slidable movement about the slide shaft 100.

In this variation, in the open position of drain closure 10 shown in FIGS. 6 and 7, the resistance element 125 is received in both the seat groove 120 of the slide shaft 100 and the groove 170, which functions as the contemplated tactile feedback detent. In the closed position of the closure assembly 130, shown in FIGS. 8 and 9, the resistance element 125 remains seated in the detent groove 170, but is unseated from the seat groove 120 of the slide shaft 100, which creates additional frictional forces to resist movement of the closure assembly 130 about the slide contour 110 of the slide shaft 100. In contrast, when the closure assembly 130 is moved toward the open position shown in FIGS. 6 and 7, the resistance element 125 expands into space adjacent the slide contour 110. Once the fully opened position is realized, the resistance element 125 essentially uncompresses, expands, and pops into seat groove 120, which can create the tactile feedback.

The clearing capability of the drain closure 10 is next discussed in more detail in connection with FIGS. 10, 11, 12 and 13. The clearing tool 150 of the drain closure assembly 130 accomplishes the rending, grinding, shearing, and disintegrating of hair, soap particles, and other debris captured in the drain basket 15, when the drain closure 130 is moved once or repeatedly into the closed position. As the drain closure 130 is moved from the upwardly projecting open position of FIGS. 6 and 7, and toward the closed position of FIGS. 8 and 9, the cutting edges 60 of the clearing tool 150 are brought into coacting contact with the shear edges 97 of the cross members 60 of the drain basket 15 to shred the debris.

Figure 10:
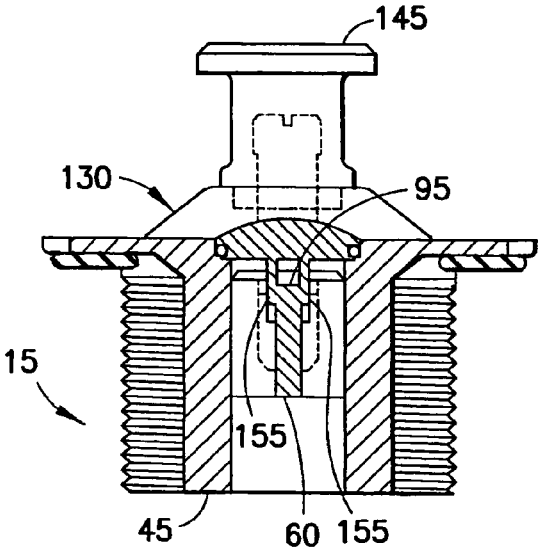
FIG. 10 is another cross section elevational view of the drain closure of the invention taken about a section plane different from that of FIGS. 6-9 to show additional features of the invention.
Figure 11:
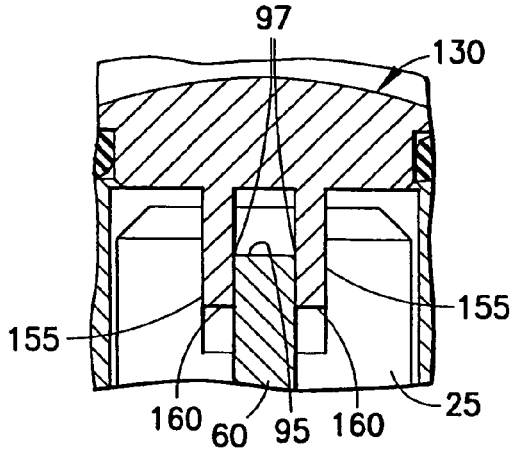
FIG. 11 is a partial detail view, in enlarged scale, of a portion of the drain closure of FIG. 10.

In the illustrations of FIGS. 10 and 11, those skilled in the art can appreciate that the paired blade arrangement 165 sandwiches the blades 155 about the sides or walls 95 of the cross members. More preferably, the cutting edges 60 of the blades 155 of the clearing tool 150 contact in a scissoring relationship against the shear edges 97 to coact therewith. As the closure assembly 130 is repeatedly moved along the slide shaft 100, the continuing shearing and scissoring action coactively shears, severs, shreds, and rends any debris captured and retained about the shear wall 95.

Figure 12:
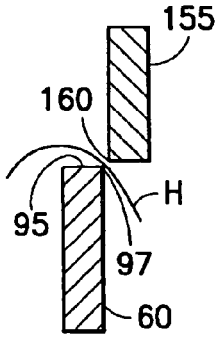
FIGS. 12 and 13 are schematic representations of certain components of the preceding figures.
Figure 13:
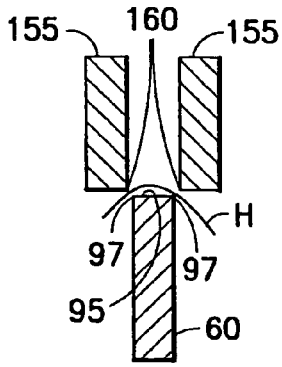

As those skilled in the art will comprehend with reference to FIG. 12, such rending, shearing, and scissoring action is possible with only one such blade, 155 and one cutting edge 160 that can be repeatedly moved against the correspondingly positioned shearing edge 97 of the cross member 60 to coact therewith. Here, debris such as strands of hair H are captured and retained about the superior shearing wall 95 of the cross member 160.

The closure assembly 130 is moved toward the drain basket 15 so that the cutting edge 160 of the blade 155 scissors against and coacts with the shearing edge 97 to sever or shear the hair, which releases the hair from the shear wall 95. Thereafter, the closure assembly 130 is moved to the open position and a fluid such as water can be supplied to the water enclosure to flow down the drain and be evacuated from the water enclosure through the drain basket 15, which washes away the shredded hair debris. In the previously described variations that employ the sandwiching pair arrangement 165 of blades 155, and as illustrated schematically in FIG. 13, a similarly effective shearing and scissoring action is contemplated.

Figure 14:
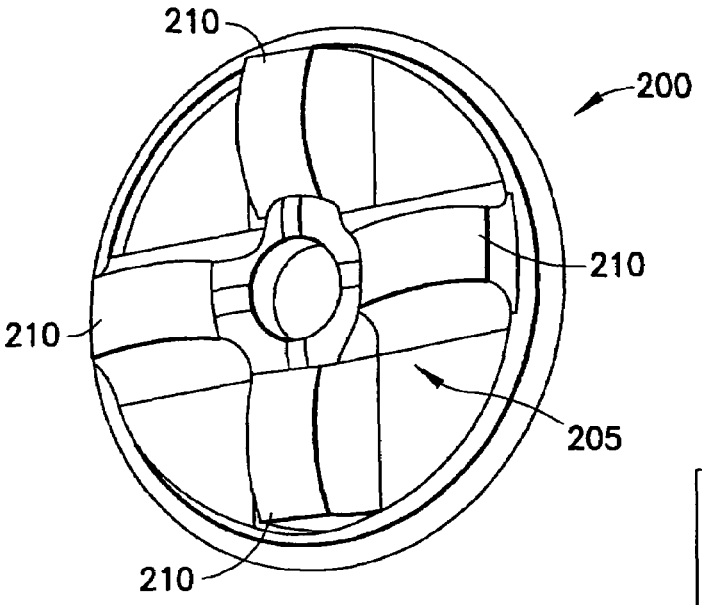
FIG. 14 is a modified component of modified drain closures according to the principles of the invention.
Figure 15:
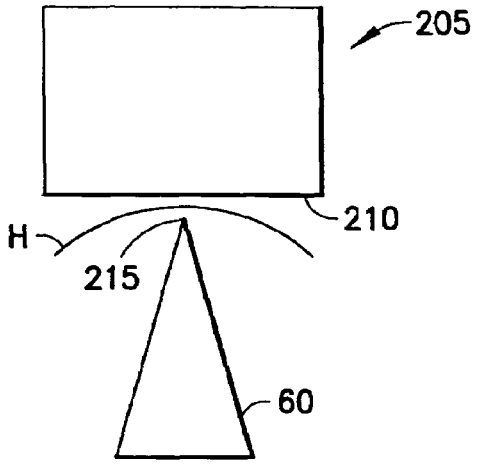
FIG. 15 is a schematic representation of a portion of the modified component of FIG. 14.

In yet other alternatively preferred configurations, a modified closure assembly 200 is contemplated as depicted in FIG. 14, wherein a different clearing tool 205 incorporates platen surfaces 210. The drain basket 15 is used as before wherein the cross members 60 are modified to have the aforementioned knife edge 215 (FIG. 15) in place of the shear wall 95 and shear edges 97. In operation, the platen surfaces 210 are brought into contact with the cross member 60 as depicted schematically in FIG. 15 to rend and sever debris such as hair for removal. Such a knife edge 215 may also be useful in combination with any of the embodiments described herein.

Figure 16:
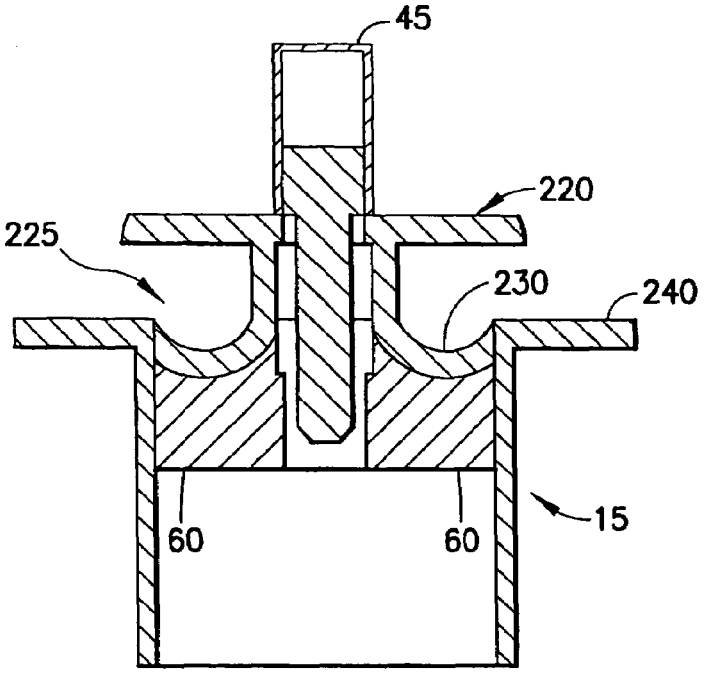
FIG. 16 is another variation of the inventive drain closure of the invention.

With reference also now to FIG. 16, those knowledgeable in the relevant fields of endeavor will understand that the clearing tools 150, 205 according to the invention also contemplate another modified closure assembly 220 having clearing tools 225 with elements such as hooks 230 adapted to be positioned in the drain basket 15 to capture and retain debris such as hair and soap particles. Upon accumulation thereof, the modified closure assembly 220 is removed from the drain basket, the debris is released, and the closure assembly is replaced in the drain basket for continued use. Such hooks 230 may be used alone or in combination with any of the preceding embodiments of the invention.

Additional clearing tools can be incorporated into any of the preceding embodiments and can include, for purposes of additional example, but not limitation, at least one replaceable or permanent optional capture element. One possibly preferred capture element can be adapted with the flexible strip and distal grip elements such as the strip and barbs described in U.S. Pat. No. 6,775,873 as noted above. Further variations may also include an adhesive 240 (FIG. 16) selected to be waterproof and to have a replaceable or permanent affinity for hair and soap particles, and which can be applied to the hooks 230 or to the distal grip elements or barbs noted above.

Figure 17:
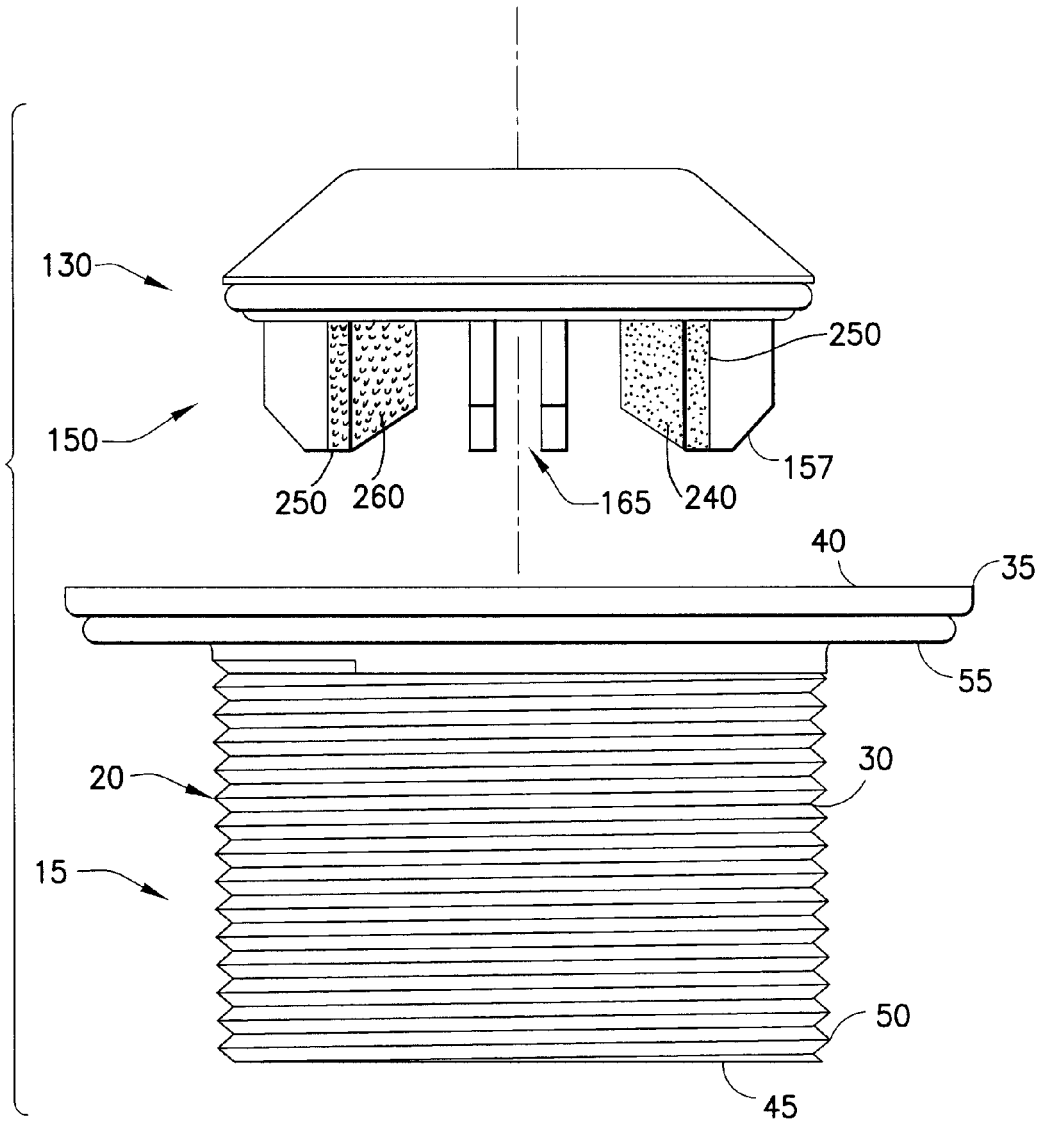
FIG. 17 is yet another variation of the inventive drain closure of the invention.

For instance, as shown in FIG. 17, capture strips 250 are incorporated in the clearing tool 150 to project inferiorly from the second end and into the drain basket 15. Each of the capture strips 250 includes a distal grip element. The capture strip 250 shown on the right includes a distal grip element in the form of a replaceable waterproof adhesive 240. The substantially planar capture strip 250 shown on the left includes a distal grip element in the form a plurality of barbs 260 protruding out of the plane of the capture strip 250.

Any or all of the components of the improved drain closure 10 can be fabricated from a wide array of possibly desirable materials that can be selected according to the type of fluid enclosure and fluids in use therein. For further example without limitation, the components may be made from plastics, ceramics, metals, and combinations and alloys thereof (e.g., stainless steel or brass). Such components may also incorporate coatings that can include chrome, nickel, or other material to change the optical, strength, or hardness characteristics of the contemplated drain closure 10. Such coatings may also be selected to have friction reducing characteristics to enable better movement of foreign matter through the drain closure 10. One possibly desirable friction reducing example includes a polymer coating such as DuPont's polytetrafluoroethylene product, also known to those skilled in the art as Teflon®.

In a further non-limiting embodiment having utility independent of and in combination with other variations, the clearing tool 150 may be formed as one or more cross members 60 included as a friction reducing element made from or that has a coating or covering with such friction reducing characteristics. More preferably, the cross member 60 is a friction reducing element formed from and or that is coated with a highly polished metal or plastic, and even more preferably that is formed from polytetrafluoroethylene. Such modified embodiments may find further use in clearing the drain closure 109 of debris by minimizing capture of such debris and optimizing passage therethrough, which can be preferred in certain applications.

Such modifications and alternative arrangements may be further optionally preferred to establish additional compatibility with the wide variety of possible applications that are compatible for use with the improved drain closure and clearing tools described and contemplated herein. Accordingly, even though only few such embodiments, alternatives, variations, and modifications of the present invention are described and illustrated, it is to be understood that the practice of such additional modifications and variations and the equivalents thereof, are within the spirit and scope of the invention as defined in the following claims.

The invention claimed is:

1. A drain closure, comprising:

a drain basket with an inlet defined by a flange and being connected through a tube to an opposite outlet and with at least one cross member carried inside the tube that extends inwardly with respect to an inner surface of the tube;

a slide shaft with a coupler end, which is connected to the at least one cross member, and extending to a slide stop about an intermediate slide contour;

a closure assembly movably received on the slide shaft about a slide bore defined in the closure assembly and that extends between a superiorly positioned handle portion and an opposite second end, the closure assembly further including a clearing tool projecting inferiorly from the second end; and at least one blade incorporated in the clearing tool and projecting inferiorly from the second end and having a cutting edge, with the blade positionally keyed about the clearing tool to coact with the at least one cross member;

wherein the at least one cross member includes at least one shear edge positioned to cooperate in a shearing action with the cutting edge as the closure assembly is moved about the slide shaft.

2. The drain closure according to claim 1, further comprising:

a plurality of blades incorporated in the clearing tool and projecting inferiorly from the second end and having respective cutting edges, the blade positionally keyed about the clearing tool whereby the blades coact with the at least one cross member; and wherein the at least one cross member includes opposite radial sides defining superior shear edges, the shear edges positioned to cooperate in a shearing action with the cutting edges sliding respectively about the opposite radial sides of the shear edges as the closure assembly is moved about the slide shaft.

3. The drain closure according to claim 1, wherein the at least one cross member includes opposite radial sides joined by a superior shear wall the shear wall defining shear edges at the intersections with the sides and further defining a collector notch, which shear edges are positioned to cooperate in a shearing action with the cutting edges sliding respectively about the opposite radial sides of the shear edge as the closure assembly is moved about the slide shaft.

4. The drain closure according to claim 1, further comprising:

a seat groove defined about the slide shaft between the intermediate slide contour and the slide stop; and a resistance element received about the seat groove of the slide shaft and sized for frictional receipt in the slide bore of the closure assembly.

5. The drain closure according to claim 1, further comprising:

an exterior seat groove formed about the closure assembly; and a seal element received about the exterior seat groove of the closure assembly sized to sealingly coact with the flange.

6. The drain closure according to claim 1, further comprising:

a cap threadably received about the handle portion and including a superiorly projecting handle.

7. The drain closure according to claim 1, further comprising:

at least one capture strip including a distal grip element and incorporated in the clearing tool to project inferiorly from the second end and into the drain basket; and wherein the closure assembly is removably received on the slide shaft.

8. A drain closure, comprising:

a drain basket with an inlet defined by a flange and being connected through a tube to an opposite outlet and with at least one cross member carried inside the tube that extends inwardly to define a guide aperture;

a slide shaft with a coupler end received in the guide aperture and extending to a slide stop about an intermediate slide contour;

a closure assembly movably received on the slide shaft about a slide bore defined in the closure assembly and that extends between a superiorly positioned handle portion and an opposite second end, the closure assembly further including a clearing tool projecting inferiorly from the second end; and at least one capture strip including a distal grip element and incorporated in the clearing tool to project inferiorly from the second end and into the drain basket, wherein the closure assembly is removably received on the slide shaft, and wherein the distal grip element is replaceable and is formed from a water proof adhesive selected to have a capture affinity.

9. The drain closure according to claim 7, wherein the at least one capture strip is substantially planar and wherein the distal grip element is at least one barb protruding out of the plane of the at least one capture strip.

10. A drain closure, comprising:

a drain basket with an inlet defined by a flange and connected by a tube to an opposite outlet and with at least one cross member carried inside the tube that extends inwardly with respect to an inner surface of the tube;

a slide shaft with a coupler end, which is connected to the at least one cross member, and extending about an intermediate slide contour to a seat groove;

a closure assembly defined with an exterior seat groove and movably received on the slide shaft about a slide bore defined in the closure assembly and that extends between a superiorly positioned cap seat and an opposite second end;

a clearing tool proximately carried about and coactive with the drain basket and closure assembly; and at least one clearing member incorporated in the clearing tool and formed about the closure assembly to project inferiorly from the second end, with the clearing member being positionally keyed about the clearing tool to coact with the at least one cross member, wherein the at least one cross member includes the at least one edge positioned to cooperate in a disintegrating action with the clearing member as the closure assembly is moved about the slide shaft.

11. The drain closure according to claim 10, wherein:

the at least one clearing member includes at least one blade incorporated in the clearing tool and having a cutting edge; and the at least one edge of the at least one cross member includes at least one shear edge positioned to cooperate in a shearing action with the cutting edge as the closure assembly is moved about the slide shaft.

12. The drain closure according to claim 10, wherein:

the at least one clearing member includes at least one platen surface included in the clearing tool and; and the at least one cross member rendingly coacts with the at least one platen surface.

13. The drain closure according to claim 10, further comprising:

at least one friction reducing element included in the clearing tool and formed as the at least one cross member.

14. The drain closure according to claim 10, further comprising:

a resistance element received about the seat groove of the slide shaft and sized for frictional receipt in the slide bore of the closure assembly.

15. The drain closure according to claim 10, further comprising:

a seal element received about the exterior seat groove of the closure assembly being sized to sealingly coact with the flange.

16. The drain closure according to claim 10, further comprising:

at least two pairs of blades incorporated in the clearing tool and projecting inferiorly from the second end and having respective inferior cutting edges;

at least two cross members each including opposite radial sides joined by respective superior shear walls defining shear edges at the radial side intersections; and wherein the at least two pairs of blades are positionally keyed about the clearing tool so that each pair coacts with a respective one of the members, whereby the respective shear edges of the cross members cooperate in a shearing action with the respective inferior cutting edges sliding about the opposite radial sides of the respective shear edges as the closure assembly is moved about the slide shaft.

17. The drain closure according to claim 10, further comprising:

a cap threadably received about the cap seat and including a superiorly projecting handle.

* * * * *

UNITED STATES PATENT AND TRADEMARK OFFICE

CERTIFICATE OF CORRECTION

PATENT NO. : 7,650,651 B2
APPLICATION NO. : 11/377525
DATED : January 26, 2010
INVENTOR(S) : Michael C. Lohnert It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 828 days.

Signed and Sealed this

Twenty-third Day of November, 2010

David J. Kappos

David J. Kappos
*Director of the United States Patent and Trademark Office*